US009334726B2

(12) United States Patent
McMiles

(10) Patent No.: US 9,334,726 B2
(45) Date of Patent: May 10, 2016

(54) PLUG AND PRESSURE TESTING METHOD AND APPARATUS

(75) Inventor: Barry J. McMiles, Houston, TX (US)

(73) Assignee: The Subsea Company, Houston, TX (US)

( * ) Notice: Subject to any disclaimer, the term of this patent is extended or adjusted under 35 U.S.C. 154(b) by 192 days.

(21) Appl. No.: 13/698,795

(22) PCT Filed: Aug. 29, 2012

(86) PCT No.: PCT/US2012/052794
§ 371 (c)(1), (2), (4) Date: Jan. 23, 2013

(87) PCT Pub. No.: WO2013/033160
PCT Pub. Date: Mar. 7, 2013

(65) Prior Publication Data
US 2014/0060848 A1 Mar. 6, 2014

(51) Int. Cl.
*E21B 7/12* (2006.01)
*E21B 49/00* (2006.01)
*E21B 33/12* (2006.01)
*E21B 47/10* (2012.01)

(52) U.S. Cl.
CPC ..... *E21B 49/001* (2013.01); *E21B 33/1208* (2013.01); *E21B 47/1025* (2013.01)

(58) Field of Classification Search
CPC ..... E21B 33/1208; E21B 47/1025
USPC ..... 166/336, 363, 368, 250.01, 179
See application file for complete search history.

(56) References Cited

U.S. PATENT DOCUMENTS

| | | | | |
|---|---|---|---|---|
| 3,800,596 | A * | 4/1974 | Phillips et al. | 73/40.5 R |
| 5,396,956 | A * | 3/1995 | Cherewyk et al. | 166/250.08 |
| 5,960,881 | A * | 10/1999 | Allamon et al. | 166/291 |
| 6,799,638 | B2 * | 10/2004 | Butterfield, Jr. | 166/386 |
| 7,207,384 | B2 * | 4/2007 | Dallas et al. | 166/250.08 |
| 7,478,674 | B2 * | 1/2009 | Johnson | 166/278 |
| 7,510,018 | B2 * | 3/2009 | Williamson et al. | 166/387 |
| 7,896,091 | B2 * | 3/2011 | Williamson et al. | 166/387 |
| 8,201,636 | B2 * | 6/2012 | Gandikota et al. | 166/387 |
| 8,528,646 | B2 * | 9/2013 | Stezycki | 166/338 |
| 8,839,872 | B2 * | 9/2014 | Purkis | 166/386 |

* cited by examiner

*Primary Examiner* — Matthew R Buck
*Assistant Examiner* — Aaron Lembo
(74) *Attorney, Agent, or Firm* — The Petruzzi Law Firm; James D. Petruzzi

(57) ABSTRACT

A plug assembly and method for pressure testing a shaft having a generally cylindrical member with a deformable outer surface comprised of alternating soft and rigid ribs and a central void for reception of a sealing component having a sealable central bore, a tubular adapter capable of releasable attachment to a drill pipe and releasably engaged to the cylindrical member, a plurality of ports about the circumference of the member for upward flow of fluid through the member and a receptacle in the member for placement of the sealing component for fixed attachment inside the member for creating a seal for testing pressure. The sealing component may use a ball valve to regulate flow and the cylindrical member may have rigid sections implanted between soft sections during manufacture to facilitate sealing upon pressurization.

20 Claims, 6 Drawing Sheets

PLUG AND PRESSURE TESTING METHOD AND APPARATUS

CROSS REFERENCE TO RELATED APPLICATIONS

This application is based on provisional U.S. patent application No. 61/529,356 entitled "Plug and Pressure Testing Method" filed on Aug. 31, 2011, which is hereby incorporated by reference as if fully set forth herein.

FIELD OF THE INVENTION

The present invention relates to a subsea testing method, and more particularly to a Plug and Pressure Testing Method and Apparatus for use with a Blow Out Preventer (BOP).

BACKGROUND OF THE INVENTION

Numerous devices presently exist for testing pressure on down hole installations used in the extraction of oil and gas. In certain applications, plugs are first inserted into a shaft and after reaching a desired location, the line is pressurized and tested for leakage and pressure readings. It is also required that the shear rams on a BOP must be tested, which means that the drill pipe needs to be disconnected, pulled up above the shear rams and then later latched back into the plug for retrieval. In many instances the devices employed are not easily removed or require extensive downtime for their operation. Thus there exists a need to more easily install and remove a plug and testing apparatus from the hole to maintain and to restore functionality to an oil and gas well.

SUMMARY OF THE INVENTION

In accordance with a preferred embodiment of the invention, there is shown a plug assembly for pressure testing a shaft having a generally cylindrical member having a deformable outer surface and a central void for reception of a sealing component having a sealable central bore, the member having a lower end having a circumference; a tubular adapter capable of releasable attachment to a drill pipe and releasably engaged to the sealing component; a plurality of ports about the circumference of the member for selective flow of fluid through the member; and a receptacle in the member for placement of the sealing component for fixed attached inside the member for creating a seal in the shaft.

In accordance with a preferred embodiment of the invention, there is shown a method for testing pressure on a blow out preventer having the steps of inserting into a shaft a generally cylindrical member having a deformable outer surface and a central void for reception of a sealing component having a sealable central bore, attaching an adapter to a drill pipe and engaging about said sealing component and inserting said sealing component into said member via pressure, pressurizing the shaft through the void to test the pressure in the shaft; removing the adapter from the member; and grinding the cylindrical member and said sealing component in situ and removing any debris from the shaft.

In accordance with a preferred embodiment of the invention, there is shown an assembly for pressure testing a blow out preventer having a generally tubular member having a deformable outer surface and a notch on the inside diameter of the member, a cylindrical sealing component engaged to an adapter and a lower end for engaging the notch, an adapter capable of releasable attachment to a drill pipe and releasably engaged to the tubular member, a plurality of ports about the circumference of the member for flow of fluid about the member, a plurality of rigid wedges radially disposed about the circumference of the tubular member between deformable regions on the outer surface.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
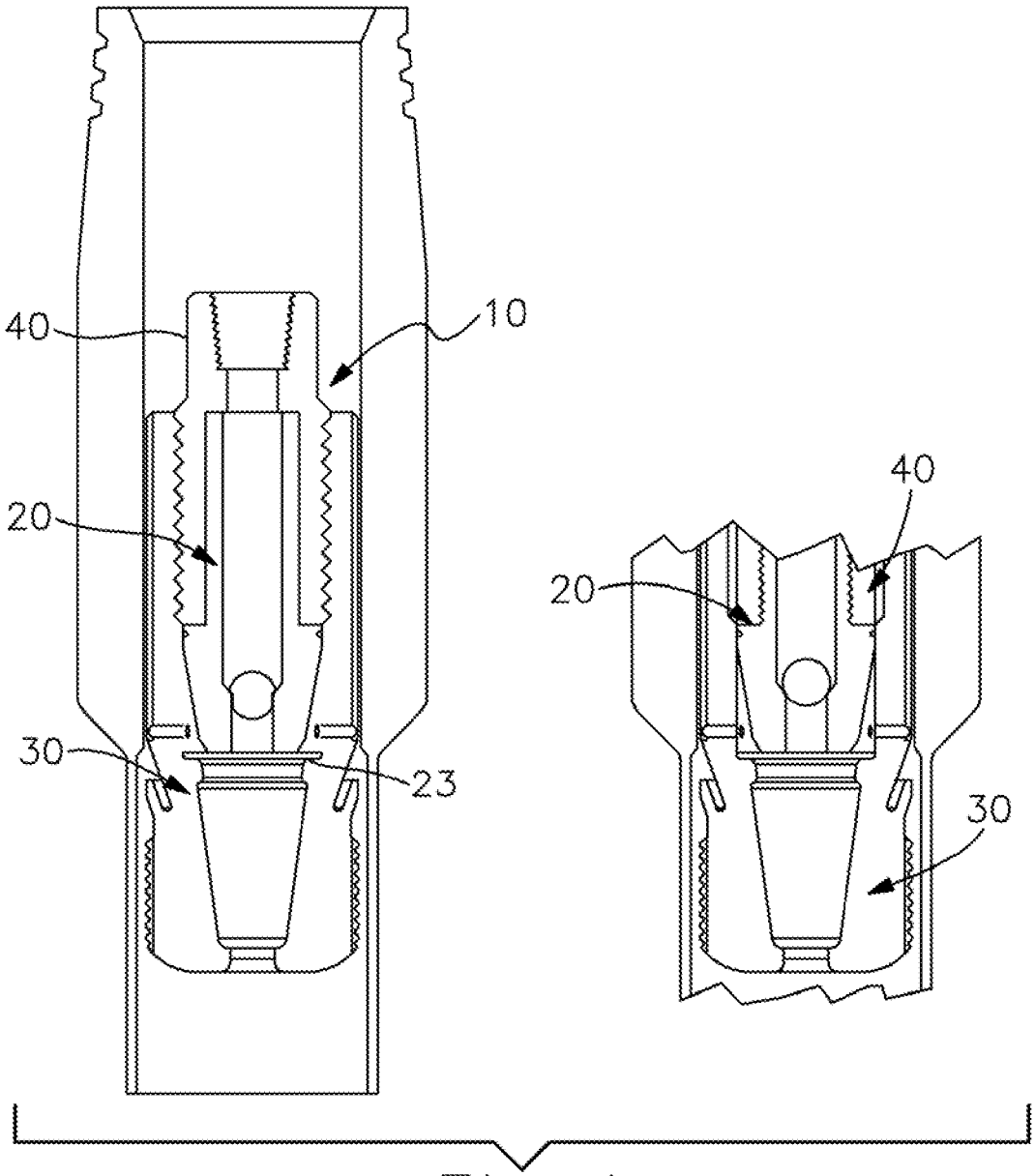
FIG. 1, shows cross sectional views of a test plug according to a preferred embodiment of the invention before full insertion into a shaft.

Referring now to FIG. 1, a cross sectional view of test plug 10 is illustrated according to a preferred embodiment of the present application. Test plug 10 is a combination deformable outer shell or housing component 30 and internal sealing component 20 having adaptor 40 for creating a pressurizeable blockage. This also allows fluid to pass through test plug 10 to keep a constant bottom hole pressure and not compromise the well formation. Test plug 10 is attached to the drill pipe by means of adapter 40 for pressurization on the top of the plug. Ports around the periphery of the plug (more fully shown in FIGS. 4 and 5) allow for flow around the plug when inserting. When testing, internal sealing component 20 is pushed into a notched receptacle to form a tight seal to pressure test. In a preferred embodiment, the periphery of the plug is comprised of lower durometer elastomer which expands upon insertion to create a tight seal. A plastic portion inside the softer outer shell has a check ball valve that moves upward if there is any upward pressure. When fully engaged, the ball valve closes and creates a seal. This permits pressure testing of the annulus. After testing, an adapter affixed to the plastic portion is right turned out and removed from the test pipe and the shear rams can be tested. Test pressure increases the seal contact pressure and also increases the bond strength of the grip. The drill bit then can grind the tool plug completely to permit removal of the plug pieces that have been cut up by the drill which will become part of the drilling returns.

As is illustrated in FIG. 1, test plug 10 includes a housing component 30, an internal sealing component 20, and adapter 40. Housing component 30 may be substantially made of a deformable elastomer and plastic combination as further described below. As test plug 10 is inserted into a well shaft, housing component 30 makes contact with the shaft's inside diameter and is generally cylindrical in shape with a central opening along its length as described below. Test plug 10 is lowered or raised to a desired depth typically below the blowout preventer and the 22" casing hanger away from the casing adapter seal areas. When it becomes desirable to operate test plug 10, a pipe connected to adapter 40, which adapter 40 is frictionally engaged to internal sealing component 20, is pressured downward to force internal sealing component 20 downward into housing component 30. Internal sealing component 20 engages notch 23 within housing component 30. As the plug is inserted, radial ports 65, shown in FIG. 4 about the periphery of the plug, permit flow upward to equalize pressure.

Figure 2:
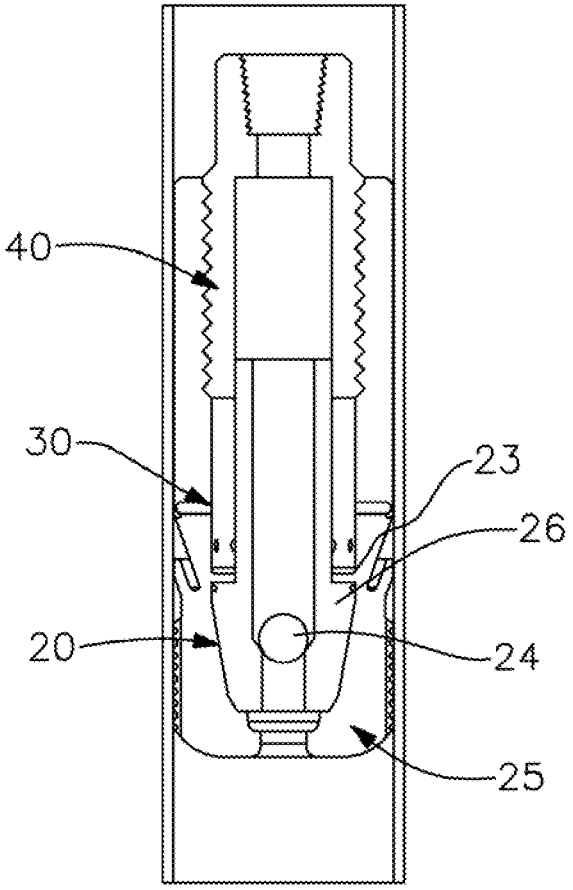
FIG. 2 shows a perspective view of a test plug according to a preferred embodiment of the invention after full insertion into a shaft.

A ball check valve 24 shown in FIG. 2 is included to equalize the external pressure with that inside the drill pipe while running in the hole pressure below internal sealing component 20. Adapter 40 is provided to establish an annular connection to the internal sealing component 20 for passage of fluid when necessary and insertion of the tool.

Figure 3:
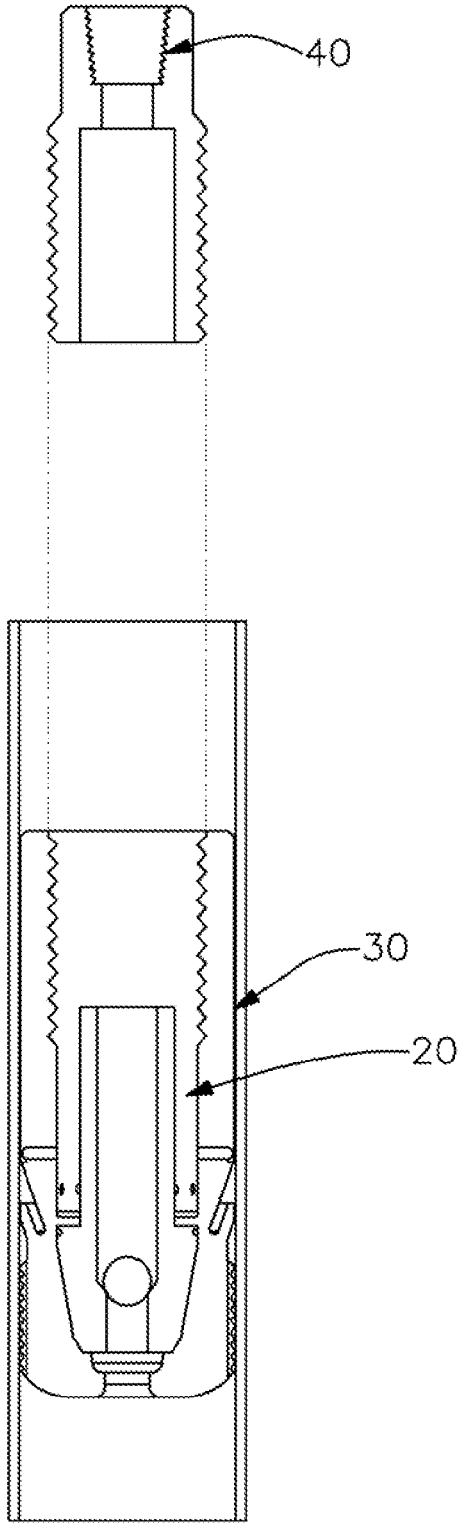
FIG. 3 shows a cross sectional view of FIG. 1 according to a preferred embodiment of the invention after insertion and removal of an adapter.
Figure 4:
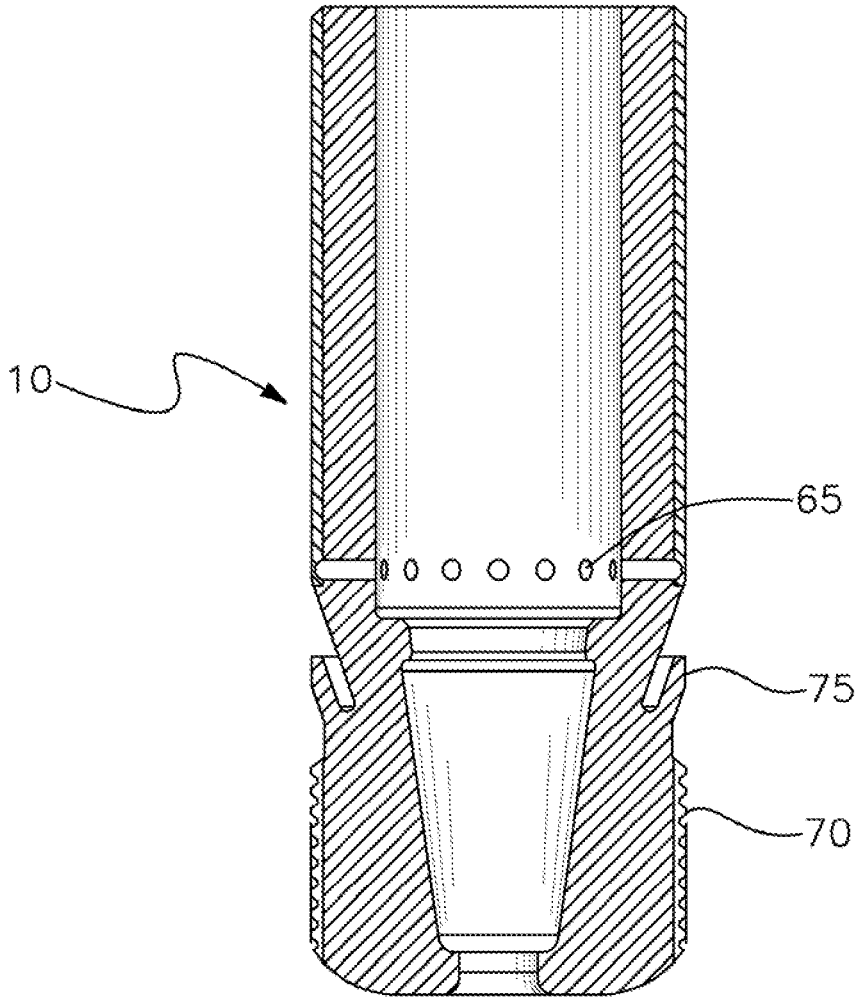
FIG. 4 shows a cross sectional view along 4-4 of FIG. 5 of a preferred embodiment of the invention.

Referring further to FIG. 2, test plug 10 is illustrated wherein internal sealing component 20 has been inserted into the preformed opening of housing component 30 and engaged at notch 23 in housing component 30. A ball check valve 24 rests to keep sealed the opening of internal sealing component 20 so that fluid is not allowed to escape. Adapter 40 remains in the resting position above the opening of internal sealing component 20. As pressure is applied through adapter 40 which is in turn engaged to pipe (not shown), pressure testing is permitted since the downward flow has been blocked by the plug assembly. This activates the internal sealing component 20 which reacts on the lower section of the housing component 30, gripping the internal walls of the pipe about radial fins 70 and setting seal lip 75 on the inside diameter (ID) as shown in FIGS. 3 and 4. The pressure can then be released from the drill pipe and the rams closed around them to allow pressure testing of the wellhead connector and other functions. The annular pressure acts down on internal sealing component 20 which increases the seal and grip on accordance with the increase of test pressure. Ball check valve 24 is now free to allow for any fluid that may bypass the seal to escape up the drill pipe so as not to over pressurize the well bore.

Upon pressurization, internal sealing component 20 is forced into housing component 30. Flared head 25 at shoulder 26 engages under notch 23 when inserted fully into housing component 30. Once plug 10 is seated, internal sealing component 20 is pushed downward and engaged stably under notch 23 in housing component 30 which forms a receptacle for the sealing component.

Referring now to FIG. 3, adapter 40 is shown removed from housing component 30 and about internal sealing component 20. Adapter 40 is preferably attached to housing component 30 via reverse threading to facilitate later removal, meaning that turning to the right loosens and turning to the left tightens. Once the normal BOP testing is complete, adapter 40 may be right screwed and removed from engagement to housing component 30. Virtually any form of engagement between adapter 40 and housing 30 may alternately be employed including traditional threading, pins, or other releasable engagement. Internal sealing component 20 remains as it is engaged via notch 23 as previously described. FIG. 3 shows adapter 40 after being removed from test plug 10. At this time the rig can remove this section from the well and continue operations while shear ram testing can continue with the drillable section remaining in the hole. The test pressure acts on top of the whole area of the plug increasing grip and sealing capability as the test pressure increases. After the bottom hole assembly is made up and the shear ram testing is complete it can run in the hole, drill out the plug and continue on to drill the hole. When one desires to remove test plug 10 from the shaft of a well bore, the test pipe is removed as previously described by right turning adapter 40 and disengaging it from the housing component 30, permitting a drill bit to go down the hole and drill out the remaining plug, comprised of housing component 30, internal sealing component 20 and ball check valve 24 which are made of elastomer and plastic.

Figure 5:
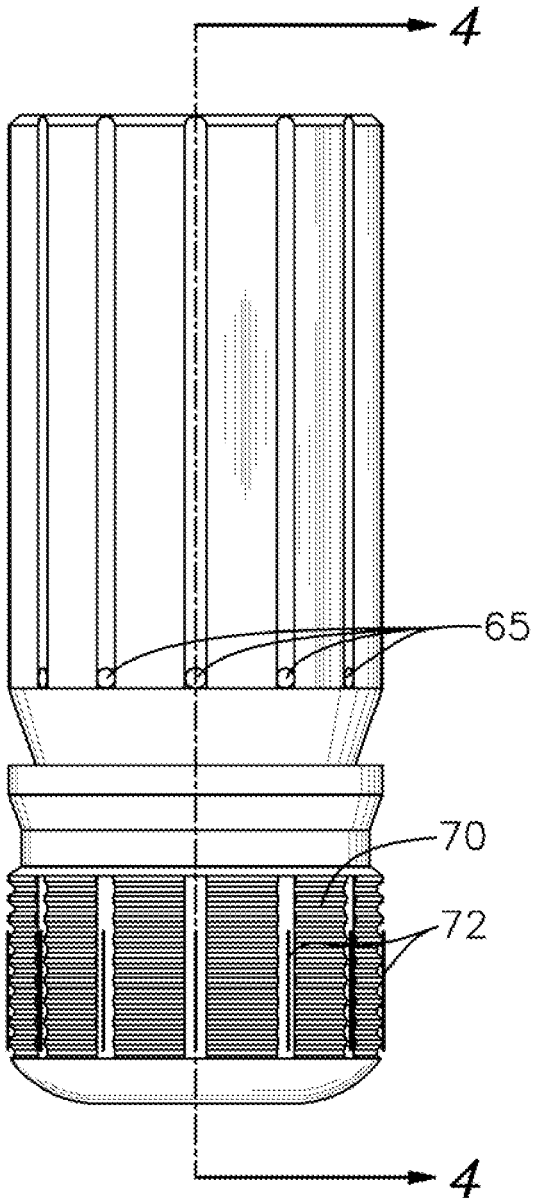
FIG. 5 shows a perspective cutaway and half portion of a preferred embodiment of the invention.

Referring now to FIG. 4, there is shown a cross sectional view of FIG. 5, along lines 4-4. In FIGS. 4 and 5, a series of radial ports 65 are depicted. According to the embodiment shown in FIG. 4, radial ports 65 extend about the outer circumference to the inside diameter of housing component 30. These ports permit the upward flow of fluid upon insertion of the plug and allow for pressure equalization before testing.

Referring now to FIGS. 4 and 5, radial fins 70 are disposed about the periphery of the deformable outer portion of housing component 30 and are composed of a soft elastomer material 72 interspersed between smaller hard plastic regions which comprise radial fins 70, generally in the area between elastomer material 72, shown in FIG. 5. Radial fins 70 are comprised of a region of somewhat stiffer pie shaped wedges of material disposed between softer elastomer material 72. The stiffer material may be molded into a preferred softer material that comprises a portion of housing component 30 during manufacture and may be situated radially about the central axis of housing component 30 at various lengths depending on user preference and desired stiffness required. The stiffer material may be pie shaped and disposed longitudinally along a length at the end within housing component 30 and in a preferred embodiment covered in part by a softer material. This combination of soft and hard material provides rigidity for pressure testing, but also allows the outer housing to conform to the inner diameter of the casing when inserted. In this way, test plug 10 is seated tight within the casing in a sealed arrangement as shown in FIGS. 2 and 3. As test plug 10 is inserted into an annulus, and pressure is disposed about test plug 10, radial fins 70 extend outward to connect with the inner diameter of an annulus to establish a grip support. As pressure is exerted on the housing component 30, and radial fins 70, the housing component 30 is sealably engaged to the inner diameter of the annulus. FIG. 4 also shows seal lip 75 which provides additional sealing engagement which improves with pressure between the housing component 30 and the inner diameter of the casing or annulus involved as shown in FIGS. 2 and 3. It is readily seen that upon engagement into the casing, fluid may flow upward through housing component 30 and expel through radial ports 65 before internal sealing component 20 is engaged and pressure testing is to begin.

In operation, test plug 10 is lowered into a drill pipe until it reaches a desired location, such as the shear rams. Once test plug 10 has reached the desired location, pressure may be increased inside the drill pipe, preferably through drilling mud or water, preferably between 3,000 and 5,000 p.s.i. As pressure increases inside the drill pipe, radial fins 70 expand allowing test plug 10 to seal about the diameter of drill pipe. While placing the plug into the casing, fluids can flow upward through radial ports 65 shown in FIG. 5. Upon pressurization, internal sealing component 20 with flared head 25 and shoulder 26 engages under notch 23 when inserted fully into housing component 30. Once the plug is seated, the internal sealing component 20 is pushed downward and engaged stably under notch 23 in housing component 30 which acts as a receptacle for internal sealing component 20. When pressurizing the plug, the ball check valve 24 is forced down into the pocket in internal sealing component 20 to create a tight seal.

After pressure testing is completed, adapter 40 is right screwed and removed leaving only destructible components made of elastomers and plastic. These are easily ground or deformed by a drill bit and flushed to the surface and removed.

Figure 6:
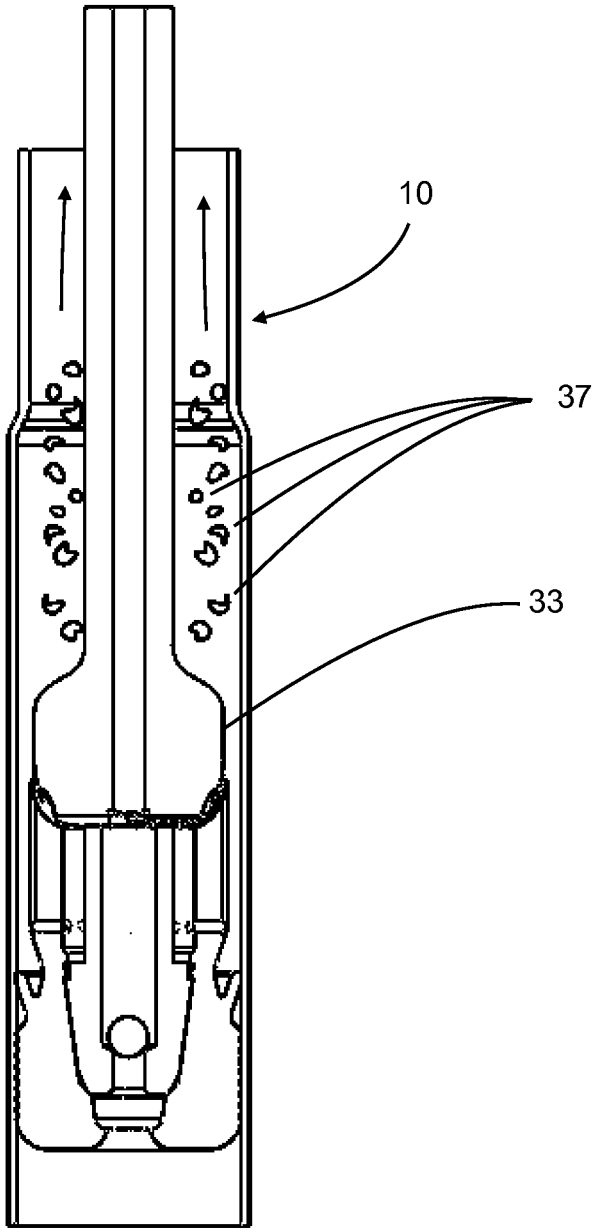
FIG. 6 shows a schematic view of a drilling operation to remove a tool according to a preferred embodiment of the invention.

FIG. 6 shows a schematic view of a drilling step for removal of the testing tool of the present invention. Drill 33 is inserted into the pipe with test plug 10 that is shown as it is drilled out and bits 37 of the ground up tool move upward out of the drill pipe. The major components of the test apparatus are destructible and are removable with a normal drilling bit commonly used in this setting.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All of the compositions and/or methods disclosed and claimed herein can be made and executed without undue experimentation in light of the present disclosure. While the compositions and methods of this invention have been described in terms of various embodiments, it will be apparent to those of skill in the art that other variations can be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the issued claims.

The invention claimed is:

1. A plug assembly for pressure testing a shaft comprising:

a. a generally cylindrical member that is deformable and a central void for reception of a sealing component having a sealable central bore, said member having a lower end having a circumference;

b. a tubular adapter capable of releasable attachment to a drill pipe and releasably engaged to said member for pressurized engagement to said sealing component to seat said component in said member for pressurized engagement to said sealing component to seat said component in said member;

c. a plurality of ports about said circumference of said member for selective flow of fluid through said member to permit pressurization of said member for sealing in said shaft; and d. a receptacle in said member for reception of said sealing component for fixed attached inside said cylindrical member for creating a seal in said shaft, wherein said ports are positioned above said seal to permit downward flow.

2. The plug assembly for pressure testing a shaft as claimed in claim 1 further comprising a ball check valve in said sealing component.

3. The plug assembly for pressure testing a shaft as claimed in claim 1 further comprising a plurality of expandable members on said surface of said member.

4. The plug assembly for pressure testing a shaft as claimed in claim 1 wherein said adapter is reverse threaded to matable threading on said cylindrical member for right hand removal of said adapter.

5. The plug assembly for pressure testing a shaft as claimed in claim 1 wherein said surface of said member is comprised of a plurality of relatively hard and soft radial ribs.

6. The plug assembly for pressure testing a shaft as claimed in claim 3 wherein said ribs are comprised of compressible material.

7. The plug assembly for pressure testing a shaft as claimed in claim 3 wherein said ribs are comprised of substantially rigid material.

8. The plug assembly for pressure testing a shaft as claimed in claim 1 further comprising a shoulder on said sealing component for stable engagement to a receptacle on said member.

9. A method for testing pressure on a blow out preventer comprising the steps of:

a. inserting into a shaft a generally cylindrical deformable member having a central void for reception of a sealing component having a sealable central bore;

b. attaching an adapter to a drill pipe and engaging about said sealing component and inserting said sealing component into said member via pressure;

c. pressurizing said shaft through said void in said sealing component to test the pressure in said shaft;

d. removing said adapter from said member; and e. drilling out said cylindrical member and said sealing component in situ and removing any debris from said shaft.

10. The method for testing pressure on a blow out preventer as claimed in claim 9 further comprising the step of attaching said adapter by reverse matable threading to said member.

11. The method for testing pressure on a blow out preventer as claimed in claim 10 further comprising the step of removing said adapter by right turning said adapter.

12. The method for testing pressure on a blow out preventer as claimed in claim 9 further comprising the step of sealing said plug with a ball valve inserted in said bore of said sealing component.

13. The method for testing pressure on a blow out preventer as claimed in claim 9 further comprising the step of engaging said sealing component to said member via a notch on inside diameter of said member.

14. The method for testing pressure on a blow out preventer as claimed in claim 9 wherein said cylindrical member comprises expandable elastomer ribs about the circumference of said member.

15. The method for testing pressure on a blow out preventer as claimed in claim 9 wherein said cylindrical member comprises substantially rigid plastic ribs about a portion of the circumference of said member.

16. An assembly for pressure testing a blow out preventer comprising:

a. a generally tubular member that is deformable and a notch on the inside diameter of said member;

b. a cylindrical sealing component engaged to an adapter and a lower end for engaging said notch;

c. an adapter capable of releasable attachment to a drill pipe and releasably engaged to said tubular member;

d. a plurality of ports about the circumference of said member below said notch for flow of fluid about said member to permit pressure about said member for engagement to said pipe; and e. a plurality of rigid wedges radially disposed about the circumference of said tubular member between deformable regions on said outer surface of said tubular member.

17. The assembly for pressure testing a blow out preventer as claimed in claim 16 further comprising a ball valve in said sealing component.

18. The assembly for pressure testing a blow out preventer as claimed in claim 16 further comprising reverse matable threading on said adapter for engagement to said sealing member for right turn release.

19. The assembly for pressure testing a blow out preventer as claimed in claim 16 further comprising a deformable circumferential lip about the outside diameter of said member.

20. The assembly for pressure testing a blow out preventer as claimed in claim 16 further comprising a notch on the inside diameter of said tubular member for engagement to the outside diameter of said sealing component.

* * * * *